US005829098A

United States Patent [19]

Alonso

[11] Patent Number: 5,829,098

[45] Date of Patent: Nov. 3, 1998

[54] REINFORCEMENT BASAL ATTACHMENT PLATE FOR RECIPROCATING OPERATIVE DEVICE

[76] Inventor: Ricardo Alonso, 111 S. Perry St., Denver, Colo. 80219

[21] Appl. No.: 731,321

[22] Filed: Oct. 15, 1996

[51] Int. Cl.[6] ..... E05F 1/00

[52] U.S. Cl. ..... 16/71; 16/271; 16/66; 16/DIG. 40

[58] Field of Search ..... 16/71, 66, 72, 16/78, 79, 80, 82–85, 49, 51, 52, 57, 58, DIG. 40, DIG. 41, 271; 403/199, 262

[56] References Cited

U.S. PATENT DOCUMENTS

| | | | |
|---|---|---|---|
| 1,001,112 | 8/1911 | Wrikeman | 16/271 |
| 1,469,525 | 10/1923 | Nadolney | 16/271 |
| 2,498,590 | 2/1950 | Straus | 16/DIG. 40 |
| 2,920,338 | 1/1960 | Falk . | |
| 3,032,806 | 5/1962 | Mallory | 16/66 |
| 3,665,549 | 5/1972 | Quinn | 16/52 |
| 3,891,111 | 6/1975 | Snazuk | 16/72 |
| 4,194,264 | 3/1980 | Soffregen | 16/52 |
| 4,382,311 | 5/1983 | Watts | 16/66 |
| 4,648,151 | 3/1987 | Whaley | 16/71 |

FOREIGN PATENT DOCUMENTS

| | | | |
|---|---|---|---|
| 623038 | 7/1961 | Canada . | |
| 398963 | 9/1933 | United Kingdom | 16/271 |

*Primary Examiner*—Chuck Mah

[57] ABSTRACT

An apparatus and method of providing improved attachment and securement for a reciprocating operative device stability control bracket (26) which comprises an arm structure (32) connected to a basal structure (28), and functions from a predetermined location which is proximal to the edge (38) of a surface (36), the improvements including a reinforcement basal attachment plate (10) of larger dimensions than the basal structure (28) of the stability control bracket (26) whereby a fastening means (12) is provided; a chambered area (14) providing securement for said basal structure (28) of the stability control bracket (26); and a primary slot (20) for accommodating the protruding arm structure (32) also of the stability control bracket (26). Furthermore, the exterior edge (16) or any interior edge (17) of the chambered area (14) may provide a secondary slot (24) whereby the stability control bracket (26) may optionally mount and demount.

9 Claims, 3 Drawing Sheets

PRIOR ART

REINFORCEMENT BASAL ATTACHMENT PLATE FOR RECIPROCATING OPERATIVE DEVICE

CROSS REFERENCE TO RELATED APPLICATIONS

This invention may be used in conjunction with my patent application Ser. No. 08/677,101, File Date: Jul. 09, 1996 now abandoned, to create a superior reciprocating operative device such as a door closer system.

BACKGROUND OF THE INVENTION

There are a variety of reciprocating operative devices such as door closer systems which utilize a stability control bracket for mounting the device onto a structure or surface. This invention relates to such devices, comprising a reinforcement basal attachment plate for fixating the stability control bracket onto the structure or surface.

DISCUSSION OF PRIOR ART

A brief description of the reciprocating door closer system comprises a spring operated device controlled with liquid or gas. It normally contains a piston assembly which includes a piston, piston rod, and cylindrical piston tube; sealed o-rings, internal compression spring or hydraulic operators, sealed and non-sealed end caps, fluid restriction valves, hold-open bracket, and attachment mechanisms including the stability control bracket concerning this invention. Such reciprocating door closer systems are described in U.S. Pat. Nos. 2,920,338; 3,032,806; 3,665,549; 4,194,264; and Canadian Pat. No. 623,038.

The stability control bracket is usually manufactured from a single piece of steel which is stamped into a distinct and functional configuration. The stability control bracket provides surface clearance for the door closer system, away from the surface of the door and the doorjamb structure. It also provides a remote hinging area for securing the reciprocating piston rod of the door closer system. Referring to prior art FIG. 6 for stability control bracket basic function.

There are two main structures which normally comprise the stability control bracket; an arm structure and a basal structure.

The arm structure is several inches in height and resembles a flattened right triangle design. Two holes which are opposed and vertically aligned support the remote hinging area. The door closer piston rod is fixated onto the remote hinging area with a pivot fastener pin. Whenever an attached door is opened or closed, the secured piston rod reciprocates from within the door closer body and pivots at the remote hinging area.

The basal structure provides both stabilization and a fastening means for the stability control bracket. The basal structure averages about 2.28 square inches, providing four fastener screw holes for fixating onto a doorjamb surface. The basal structure is required to be fixated proximal to the exterior edge of the doorjamb structure. This requirement is necessary to permit maximum door swing, and is standardized criteria for most reciprocating door closer systems.

Lateral forces and pressure generated by the functioning door closer system onto the stability control bracket is determined by the continual reciprocating action whereby the system was designed, and by the horizontal forces of the attached door. It is then common that the pressure demand applied onto the stability control bracket is greater than the 2.28 square inch basal structure can withstand. When fixated onto the typical doorjamb structure comprises a ¾ inch thick softwood pine board, the stability control bracket is often loosened or detached. The damaging results include an enlarging of the wooden fastener screw holes upon the wooden doorjamb structure, sometimes even creating a gross splintering of the wood itself.

There are several impractical solutions to combat this loosening and detachment problem of the stability control bracket from atop the doorjamb structure. The simplest method of solution involves the insertion of thicker wooden screws into the enlarged wooden holes. This usually results in only a temporary solution as the wooden fastener screw holes eventually again wear bigger. Another method of solution involves the relocation of the stability control bracket proximal to the existing worn area, without moving the entire door closer system itself. However, if the stability control bracket is relocated inward towards the center of the doorjamb, maximum door swing is compromised due to the position requirement of the basal attachment area (proximal to the exterior edge of the doorjamb structure). If the relocation of the stability control bracket is either up or down from the worn holes, the result is a horizontal tilting of the door closer system. Another more complicated yet permanent solution involves the complete relocation of the entire door closer system. However, because the placement of the door closer system is limited upon the doorjamb structure and the installation procedure is somewhat difficult, this solution is not entirely preferred. Therefore, a loosened or detached stability control bracket often results in the removal of the deemed annoying door closer system.

The present invention comprises an apparatus and method which will permit an improved attachment and securement of the stability control bracket atop the doorjamb structure, even over worn or enlarged screw holes. This simple device known as a reinforcement basal attachment plate will retrofit to most existing stability control brackets. Substantially eliminated is the need for usage of thicker wooden screws, the relocation of stability control bracket, the relocation of the entire door closer system, or any other impractical method of solution. Furthermore, the greater basal attachment can be designed to secure the stability control bracket onto the doorjamb structure without the need for permanent fixation. This would allow for the complete removal of the stability control bracket (for those mounted on the lower doorjamb structure), providing a temporary widening of the overall entryway for passage of large items such a furniture and appliances. The reinforcement basal attachment plate may become part of a complete superior door closer system, which would substantially eliminate loosening and unwanted detachment of the stability control bracket.

SUMMARY OF THE INVENTION

The objects and advantages of this invention incorporate a reinforcement basal attachment plate for mounting a stability control bracket onto a surface, at a predetermined required location upon the surface. The basal attachment plate utilizes a larger area than the confined basal structure of the stability control bracket. An object of this improvement is to provide a greater area for distribution of the pressure transferred from the functioning the door closer system, onto the basal structure of the stability control bracket. Another object of this improvement is to accommodate for a greater fastener area unto the doorjamb structure, consisting of more fastener screw holes or a larger area for an adhesive fastener. Another object of this improvement is to provide a fastener area beyond the existing attachment area, permitting the attachment onto a worn or damaged area, without having to proximally relocate the stability control bracket or move the entire door closer system.

The basal attachment plate further provides a chambered area in relationship to the basal structure of the stability control bracket. The size and shape of the chambered area shall be predetermined to retrofit most prior art basal structures. An object of this improvement is to accommodate the basal structure of the stability control bracket. Consequently, a secure union is provided for the basal structure and the doorjamb structure, without the need to permanently fixate the stability control bracket.

The chambered area further provides a primary slot, whereby the arm structure of the stability control bracket protrudes from the backside of the basal attachment plate. An object of this improvement is to retrofit the stability control bracket without the need to modify it's designed configuration. The primary slot further includes a convexity end design located at an interior edge of the chambered area. An object of this improvement is to compensate for the convexity designed backside of the arm structure, which is typical of the stability control bracket.

The primary slot is positioned at a predetermined location, approximately ¼ inches away from the exterior edge of the basal attachment plate and the chambered area. An object of this improvement is to accommodate the necessary distance of the stability control bracket, proximal to the exterior edge of the doorjamb structure. Another object of this improvement is to provide an easy guide for installation onto the doorjamb structure, substantially maintaining the proper distance away from the exterior edge.

Because the primary slot is located at such a minimal distance from the exterior edge from the basal attachment plate, a reinforcement is added on the exterior edge. An object of this improvement is to provide strength for the area of least material, which realizes certain forces and pressures during the function of the complete reciprocating door closer system.

Furthermore, the interior edge which is parallel and opposite to the exterior edge of the chambered area, can provide an optional secondary slot. An object of this invention is to allow for easy removal of the stability control bracket from the basal attachment plate without the need to remove the permanent fasteners. Often the movement of large objects such as furniture or appliances require removal of stability control bracket.

LIST OF REFERENCE NUMERALS

Figure 1:
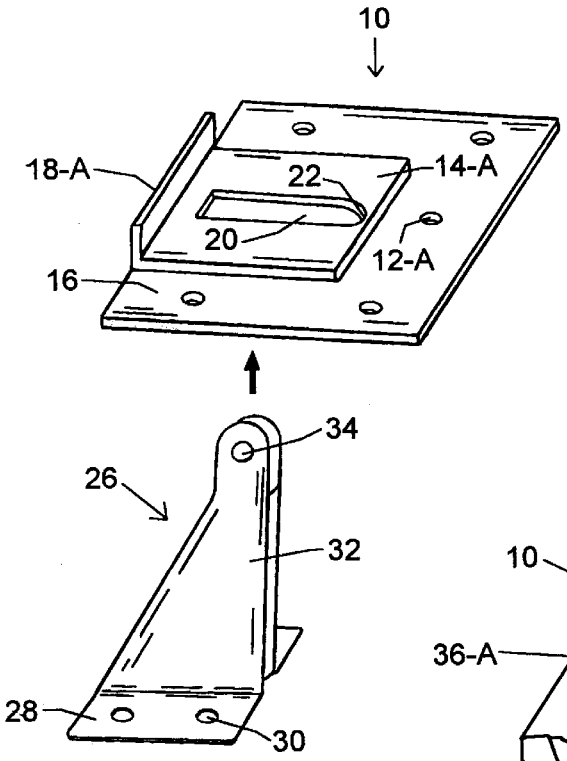
FIG. 1 is a prospective view of the superior reinforcement basal attachment plate, shown with a prior art stability control bracket in position for mounting unto the invention.

10 basal attachment plate
12 fastening means of 10
  12-A fastener screw holes of 10
  12-B adhesive fastener of 10
14 chambered area of 10
  14-A embossment chamber of 10
  14-B hollowed chamber of 10
  14-C prefabricated doorjamb chambered area
16 exterior edge of 10
17 interior edge of 14
18 exterior edge reinforcement of 16
  18-A angular bend reinforcement of 16
  18-B gusset reinforcement of 16
  18-C additional material reinforcement of 16
20 primary slot of 14
22 convexity designed end of 20
24 secondary slot of 14
26 stability control bracket
28 basal structure of 26
30 fastener screw holes of 28
32 arm structure of 26
34 remote hinging area of 32
36 doorjamb structure
  36-A wooden doorjamb structure
  36-B metal doorjamb structure
38 exterior edge of 36
40 reciprocating door closer system
41 pivot fastener pin of 34
42 door closer body of 40
44 reciprocating piston rod of 40
46 lateral forces generated by 40
48 vertically transferred pressure onto edges of 28

DETAILED DESCRIPTION OF THE PREFERRED EMBODIMENTS

FIG. 1 is a prospective view of the basal attachment plate 10 comprising an apparatus stamped or molded from material selected from the group of natural or synthetic fibers, metals, or plastics. The basal attachment plate 10 is supported by five fastener screw holes 12-A, contributing to a greater fastening means 12. The apparatus provides an embossment chamber 14-A of predetermined dimensions. The exterior edge 16 provides an angular bend reinforcement 18-A. A primary slot 20 of a predetermined size and location is positioned proximal to the exterior edge 16. A convexity designed end 22 is provided on the interior end of the primary slot 20.

Positioned underneath the basal attachment plate 10 is a prior art stability control bracket 26, stamped from a single piece of steel. The apparatus comprises a basal structure 28 providing four fastener screw holes 30 and a arm structure 32 of a right triangle design. A remote hinging area 34 is provided for attachment of a standard reciprocating door closer system (not shown). The stability control bracket 26 is shown in position to properly mount unto the embossment chamber 14-A of the basal attachment plate 10.

Figure 2:
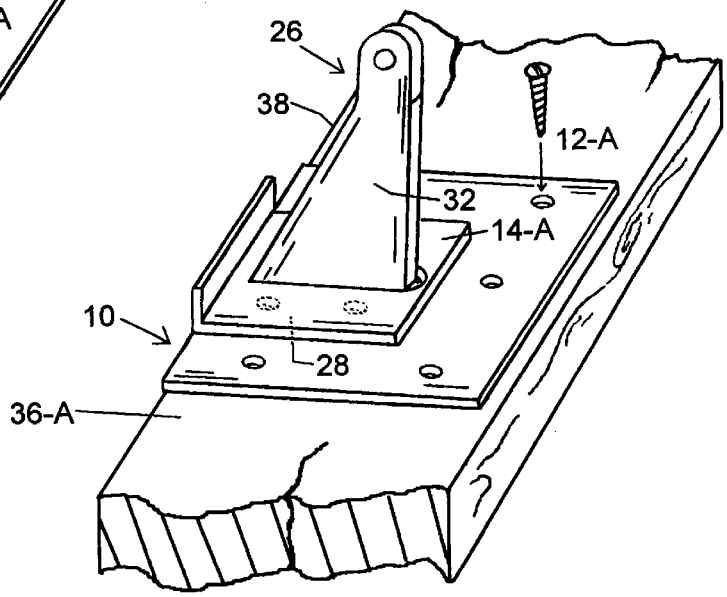
FIG. 2 is a prospective view of the superior reinforcement basal attachment plate shown with a properly mounted prior art stability control bracket, and placed in a proper position proximal to the exterior edge of a wooden doorjamb structure.

FIG. 2 is a prospective top view of the mounted invention, demonstrating the basal attachment plate 10 including the stability control bracket 26 properly positioned underneath. The embossment chamber 14-A is securing the basal structure 28 of the stability control bracket 26. Protruding from the primary slot 20 is the arm structure 32, also of the stability control bracket 26. The basal attachment plate 10 is properly positioned atop the wooden doorjamb structure 36-A, flush with the exterior edge 38. Therefore, the stability control bracket 26 is also in proper position atop the wooden doorjamb structure 36-A, proximal to the exterior edge 16. A fastener screw is positioned to attach the fastener screw hole 12-A onto the wooden doorjamb structure 36-A. Note that the fastener screw holes 30 of the stability control bracket 26 are not used to fixate unto the wooden doorjamb structure 36-A.

Figure 3:
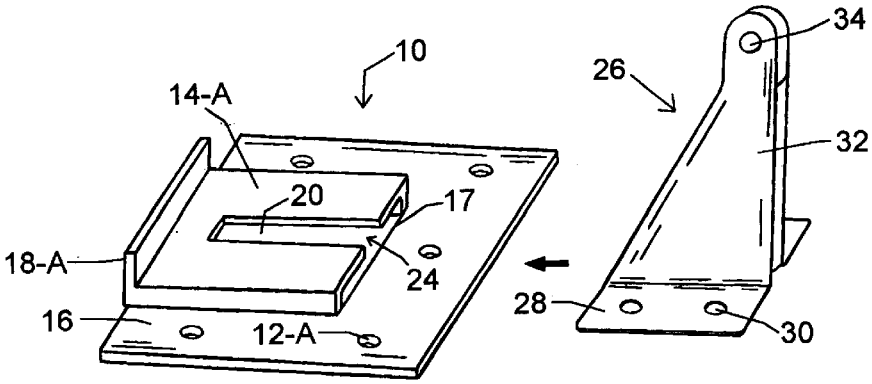
FIG. 3 is a prospective view of a superior reinforcement basal attachment plate designed with a secondary slot on the interior edge of the embossment chamber, shown with a stability control bracket in position for mounting unto the invention.

FIG. 3 is a prospective view of another basal attachment plate 10 designed to provide a secondary slot 24, located on the preferred interior edge 17 of the embossment chamber 14-A. A stability control bracket 26 as described in FIG. 1 is positioned to mount the embossment chamber 14-A. The mounting procedure involves engaging the basal structure 28 into the secondary slot 24, while the arm structure 32 is guided into the primary slot 20, until the basal structure 28 is secured or snapped into the embossment chamber 14-A. Removal of the stability control bracket 26 is conducted in the reverse order of the mounting procedure, without the need to unfasten the basal attachment plate 10 from atop the doorjamb structure (not shown). Note that the fastener screw holes 30 are not necessary to fixate the stability control bracket 26.

Figure 4:
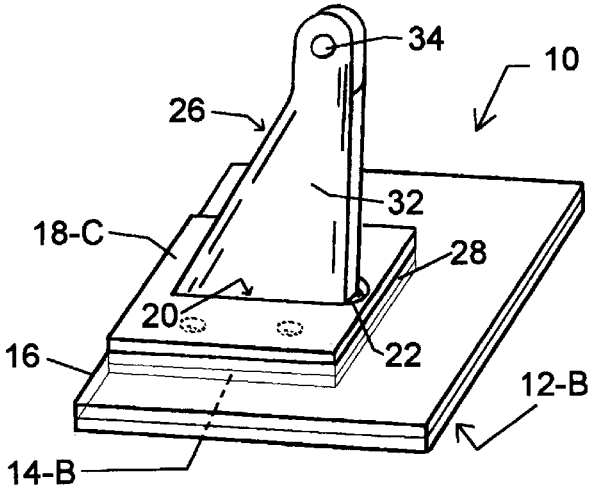
FIG. 4 is a prospective view of a superior reinforcement basal attachment plate designed with a thicker material and an adhesive fastener, and shown with a properly mounted stability control bracket.

FIG. 4 is a prospective view of another basal attachment plate 10 which demonstrates an adhesive fastener 12-B. A thicker material structure such as plastic or laminate, permits a hollowed chamber 14-B. The exterior edge 16 accommodates an additional material reinforcement 18-C. A stability control bracket 26 as described in FIG. 1 is securely mounted underneath the hollowed chamber 14-B, demonstrating the arm structure 32 protruding from the primary slot 20.

Figure 5:
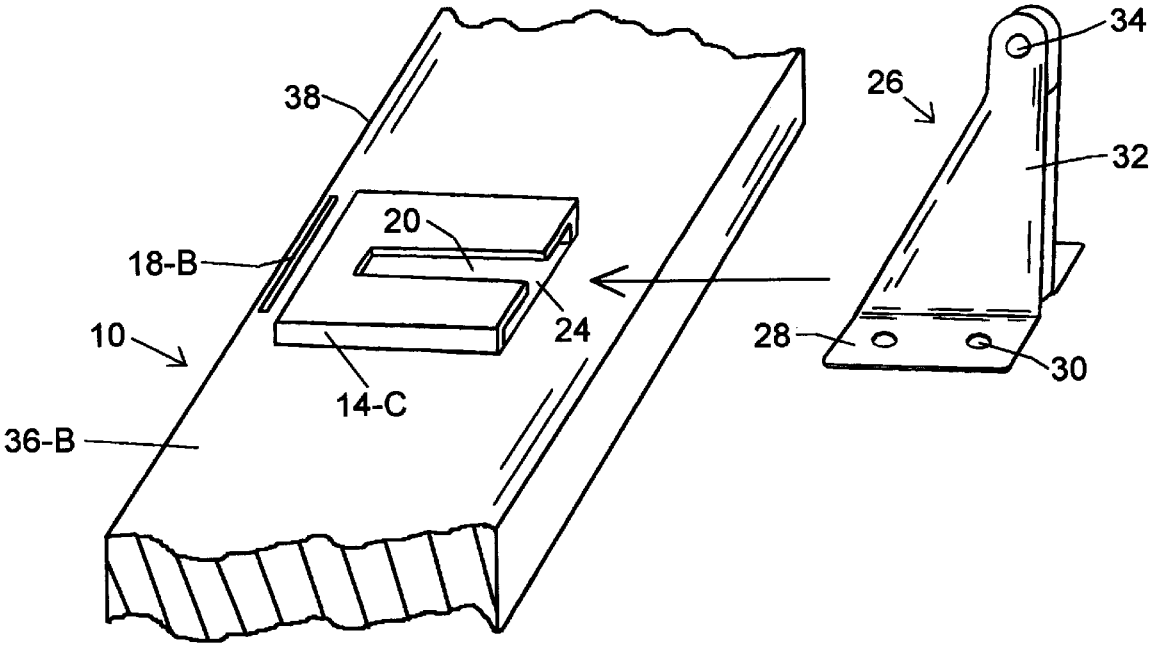
FIG. 5 is a prospective view of a superior reinforcement basal attachment plate including a prefabricated doorjamb chambered area on a metal doorjamb structure, shown with a stability control bracket in position for mounting unto the invention.

FIG. 5 demonstrates a prefabricated doorjamb chambered area 14-C installed in a metal doorjamb structure 36-B. The exterior edge 16 accommodates a gusset reinforcement 18-B. The stability control bracket 26 as described in FIG. 1 is shown in position to properly mount unto the embossment chamber 14-A of the basal attachment plate 10. Note that no basal attachment plate 10 or fastening means 12 is shown with a prefabricated doorjamb chambered area 14-C.

PRIOR ART

Figure 6:
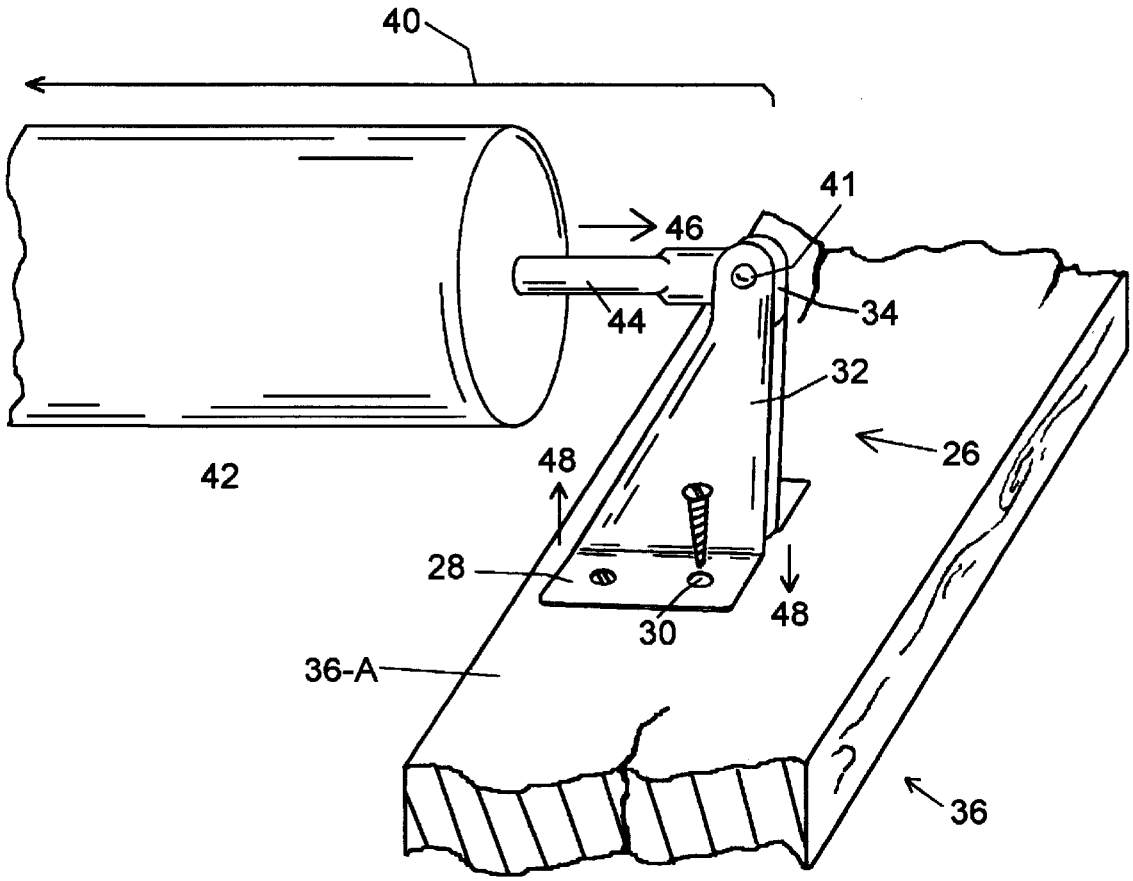
FIG. 6 is a prospective view of a mounted prior art reciprocating door closer system attached to a stability control bracket, and demonstrating the forces and pressures generated by the system.

FIG. 6 demonstrates a door closer system 40 mounted unto a wooden doorjamb structure 36-A, including a door closer body 42 and reciprocating piston rod 44, attached to the remote hinging area 34 of the arm structure 32 with a pivot fastener 41. Lateral forces generated 46 by the functioning door closer system 40 and attached door (not shown) applied onto the remote hinging area 34 during operation, results in a vertically transferred pressure 48 onto the front and back edges of basal structure 28.

Referring to the drawings, the apparatus and method of providing a reinforcement basal attachment plate for reciprocating operative device stability control brackets, primarily comprises a basal attachment plate 10 for attaching onto the doorjamb structure 36; a chambered area 14 for securing the basal structure 28 of the stability control bracket 26; and a primary slot 20 for accommodating the arm structure 32, also of the stability control bracket 26.

The invention includes a basal attachment plate 10 providing a greater area than the basal structure 28 of the stability control bracket 26. The dimensions of the basal attachment plate 10 are predetermined to provide an area of approximately 11.38 square inches, compared to the average 2.28 square inches of basal structure 28. Therefore, securement onto the doorjamb structure 36 is substantially improved, whereby lateral forces 46 and vertically transferred pressure 48 generated by the door closer system and the door are better distributed. Furthermore, the basal attachment plate 10 is able to tolerate an improved fastening means 12, consisting of more fastener screw holes 12-A, or a larger adhesive fastener 12-B. When attempting to reattach a stability control bracket 26 onto a wooden doorjamb structure 36-A, whereby the fastener screw holes 30 have loosened or detached, the invention compromises the procedure. Because the basal attachment plate 10 provides it's own fastening means 12, reinstallation of the stability control bracket 26 over a worn area is entirely possible.

The chambered area 14 of a predetermined size provides an area of securement for the basal structure 28 of the stability control bracket 26. The chambered area 14 permits a secured union between the basal structure means 28 and the surface of the doorjamb structure 36, without stressing the basal attachment plate 10, without stressing the fastening means 12, or without stressing the chambered area 14. The chambered area 14 further permits that the stability control bracket 26 need not be permanently fixated onto the doorjamb structure 36. Therefore, the chambered area 14 provides adequate stability and fixation onto the doorjamb structure 36. The chambered area 14 may consist of an embossment chamber 14-A when stamp-manufacturing the invention from steel, or a hollowed chamber 14-B when manufacturing the invention from a molded or laminated material, or a prefabricated doorjamb chambered area 14-C. Other similarly created indentation structures may be suitable to provide the chambered area 14, including an area providing a fastener means 12 for the basal structured 28.

The primary slot 20 provides an accommodation for the arm structure 32 of the stability control bracket 26, whereby the arm structure 32 protrudes from the surface of the chambered area 14. The size and shape of the primary slot 20 is predetermined to retrofit the arm structure 32 without the need to substantially modify the basic structure or design of the stability control bracket 26.

Insertion of the stability control bracket 26 into the chambered area 14 and the primary slot 20 may occur in two different methods. The first method involves the insertion from the underside of the basal attachment plate 10 until the basal structure 28 is secured within the chambered area 14. The primary slot 20 may include a convexity designed end 22, to accommodate for the rounded nature of the backside of the arm structure 32. Insertion of the stability control bracket 26 must occur prior to the fixation of the basal attachment plate 10 onto the doorjamb structure 36. However, this method does not permit the removal of the stability control bracket 26 without first detaching the fastener means 12 from atop the doorjamb structure 36.

The second method of insertion of the stability control bracket 26 functions best with an embossment chamber 14-A. It involves a secondary slot 24 provided along any edge of the embossment chamber 14-A. There are four edges which comprise the embossment chamber 14: one exterior edge 16 and three interior edges 17. Therefore, there are four edges which may accommodate the secondary slot 24. The preferred location for the secondary slot 24 incorporates the interior edge 17 of the embossment chamber 14-A which is perpendicular to the primary slot 20. This edge provides the most clearance for the removal procedure of the stability control bracket 26 from atop the doorjamb structure 36. It also permits the invention to remain universal to either a right-handed or left-handed doorjamb structure 36. Furthermore, placement of the secondary slot 24 on the exterior edge 16 may hamper the removal of the stability control bracket 26 from the basal attachment plate 10 by interfering with the edge of the door structure (not shown). The interior edge 17 of the embossment chamber 14-A may also include a keeper or lip for additional resistance and securement for the basal structure 28. Lateral forces generated 46 by the functioning door closer system 40 and attached door (not shown) applied onto the remote hinging area 34 and the pivot fastener pin 41 of the stability control bracket 26 results in a vertically transferred pressure 48 onto the front and back edges of basal structure 28. This notion is what permits the stability control bracket 26 to properly function from within the embossment chamber 14-A comprising a secondary slot 24, without loosing securement from within.

The most critical requirement of the chambered area 14 and the primary slot 20 is that they are located proximal to the exterior edge 16 of the basal attachment plate 10. This location is necessary to accommodate the standardization of the modern reciprocating door closer system 40, and the requirements for the stability control bracket 26 to function proximal to the exterior edge 38 of the doorjamb structure 36 as designed. Because the chambered area 14 and the primary slot 20 are so close to the exterior edge of the basal attachment plate 10, certain lateral pressures and varying forces which are generated by the door closer system 40 and the attached door may cause the exterior edge 16 to become stressed. To compensate for the stress the material structure on the exterior edge 16 is compromised and strengthened with an exterior edge reinforcement 18 consisting of an angular section of material 18-A, a gusset 18-B, additional material added 18-C, or other reinforcement means 18 appropriate.

For many years, the consumer public has suffered from door closer system loosening and detachment of the stability control bracket from atop the doorjamb structure. Another known problem is the necessary removal of the stability control bracket to permit the passage of larger objects such as furniture, which requires removal of the permanent fasteners. The preferred embodiments of this invention substantially eliminates these problems.

All inventions herein provide a reinforcement basal attachment plate for reciprocating operative device stability control brackets. To summarize, the basal attachment plate permits an improved securement and attachment of the stability control bracket onto a surface, even when reattaching atop a worn fastening area. A chambered area provides a securement for the stability control bracket without permanent fixation. A primary slot permits for accommodation of the stability control bracket without the need to substantially modify it's functional design. Furthermore, a secondary slot permits easy removal of the stability control bracket from the doorjamb structure, permitting a temporary widening of the doorway.

Accordingly, the reader will understand that the complete reciprocating door closer system is substantially improved through the preferred embodiments of these inventions. Although the description above contains many specifications, these should not be construed a limiting the scope of the invention but as merely providing illustrations of the some of the preferred embodiments of this invention. For example, the reinforcement basal attachment plate can be modified to any size and shape, used for other reciprocating operative device stability control brackets such as cabinetry closer systems, commercial closer systems, and reciprocating industrial equipment.

Thus the scope of the invention should be determined by the appended claims and their legal equivalents, rather than the examples given.

I claim:

1. An apparatus for improved securement in the mounting of a reciprocating operative device stability control bracket upon a stationary surface, the stability control bracket comprised of at least one arm structure of given dimension with basal structure of given dimension appended thereto, the improvements in combination therewith comprising a reinforcement basal attachment plate of greater dimensions than those of the basal structure, said reinforcement basal attachment plate including a primary slot therein of dimension sufficient to accommodate the insertion of the arm structure therethrough, said reinforcement basal attachment plate further including a chambered area therein so disposed and of such dimension as to retain the basal structure of the stability control bracket when the arm structure of the stability control bracket is inserted through the primary slot of said reinforcement basal attachment plate;

a fastening means for affixing said reinforcement basal attachment plate to the stationary surface.

2. The improved apparatus of claim 1 wherein said reinforcement basal attachment plate further includes a secondary slot therein, communicating with the chambered area and accommodating the insertion and removal of the basal structure of the stability control bracket to and from the chambered area in said reinforcement basal attachment plate when said reinforcement basal attachment plate is affixed to the stationary surface.

3. The improved apparatus of claim 2 further comprising a keeper means for providing resistance to removal of the basal structure from the secondary slot in said reinforcement basal attachment plate.

4. The improved apparatus of claim 1, wherein the chambered area in said reinforcement basal attachment plate is formed by processes selected from the group of embossing said reinforcement basal attachment plate, hollowing said reinforcement basal attachment plate, and prefabricating a surface of said reinforcement basal attachment plate to form the chambered area.

5. The improved apparatus of claim 1, wherein said reinforcement basal attachment plate is composed of material selected from the group consisting of natural and synthetic fibers, metals, plastics, and laminates.

6. The improved apparatus of claim 1, wherein said fastening means is selected from the group consisting of fastener screws, and an adhesive fastener.

7. An improved method for securement in the mounting of a reciprocating operative device stability control bracket upon a stationary surface, the stability control bracket comprised of at least one arm structure with basal structure appended thereto, using a reinforcement basal attachment plate, said reinforcement basal attachment plate including a slotted means for accommodating the insertion of the arm structure therethrough, said reinforcement basal attachment plate further including a chambered means for retaining the basal structure of the stability control bracket when the arm structure of the stability control bracket is inserted through the slotted means of said reinforcement basal attachment plate, the improved method comprising the steps of:

inserting the arm structure of the stability control bracket through the slotted means of the reinforcement basal attachment plate, disposing the stability control bracket so that the basal structure of the stability control bracket is retained by the chambered area means of the reinforcement basal attachment plate; and affixing the reinforcement basal attachment plate to the stationary surface.

8. An improved method for securement in the mounting of a reciprocating operative device stability control bracket upon a stationary surface, the stability control bracket comprised of at least one arm structure of given dimension with basal structure of given dimension appended thereto, using a reinforcement basal attachment plate, said reinforcement basal attachment plate further including a chambered area therein so disposed and of such dimension as to retain the basal structure of the stability control bracket, said reinforcement basal attachment plate further including therein a slotted means for accommodating the insertion of the arm structure therethrough, said slotted means further communicating with the chambered area and accommodating the insertion and removal of the basal structure of the stability control bracket to and from the chambered area in said reinforcement basal attachment plate when said reinforcement basal attachment plate is affixed to the stationary surface, the improved method comprising the steps of:

affixing the reinforcement basal attachment plate to the stationary surface; and inserting the basal structure of the stability control bracket into the slotted means so that the basal structure of the stability control bracket is retained in the chambered area of the reinforcement basal attachment plate while the arm structure of the stability control bracket protrudes from the reinforcement basal attachment plate.

9. An improved method for securement in the mounting of a reciprocating operative device stability control bracket upon a stationary surface as in claim 8, said method further comprising the step of:

resisting the removal of the basal structure from the slotted means in said reinforcement basal attachment plate.

* * * * *